United States Patent [19]

Kappes

[11] 4,279,187

[45] Jul. 21, 1981

[54] DIGITAL ARPEGGIO SYSTEM FOR ELECTRONIC MUSICAL INSTRUMENT

[75] Inventor: Joseph L. Kappes, Cincinnati, Ohio

[73] Assignee: Baldwin Piano & Organ Company, Cincinnati, Ohio

[21] Appl. No.: 110,619

[22] Filed: Jan. 9, 1980

[51] Int. Cl.[3] ..... G10F 1/00

[52] U.S. Cl. ..... 84/1.03; 84/1.24

[58] Field of Search ..... 84/1.03, DIG. 12, 1.24, 84/1.26

[56] References Cited

U.S. PATENT DOCUMENTS

| | | | |
|---|---|---|---|
| 4,144,788 | 3/1979 | Bione et al. | 84/1.03 |
| 4,160,399 | 7/1979 | Deutsch | 84/1.03 |
| 4,185,530 | 1/1980 | Robinson et al. | 84/1.03 |
| 4,187,756 | 2/1980 | Robinson et al. | 84/1.03 |
| 4,192,212 | 3/1980 | Yamaga et al. | 84/1.03 |
| 4,202,236 | 5/1980 | Wilcox et al. | 84/1.03 |

*Primary Examiner*—J. V. Truhe

*Assistant Examiner*—Forester W. Isen

*Attorney, Agent, or Firm*—Kirkland & Ellis

[57] ABSTRACT

An arpeggio system, utilizing bipolar digital logic devices in all control and sequencing functions, generates a variety of arpeggio and strum note patterns. A key operated switch enables a NOR logic note gate, or a series of octavely related note gates, and activates a system clock which causes a pulse to be transmitted along a chain of shift registers, one of which corresponds to each note of the organ. If a given note gate has been enabled when its corresponding shift register is pulsed, the note gate is triggered. When a note gate is triggered, the system clock pauses for a preselected interval allowing the signal from a corresponding tone generator to be sounded through an appropriate system of filters and amplifiers. The system clock can cause the shift registers to scan in the up, down, or up and then down directions. An octave priming device can permit the sounding of notes in higher octaves which correspond to notes actually played.

16 Claims, 6 Drawing Figures

DIGITAL ARPEGGIO SYSTEM FOR ELECTRONIC MUSICAL INSTRUMENT

BACKGROUND OF THE INVENTION

1. Field of the Invention

The present invention relates to musical instruments, and more particularly, to electronic musical instruments having means for automatically producing an arpeggio or similar note pattern.

2. The Prior Art

Automatic arpeggio systems for electronic musical instruments are known in the art. Arpeggio systems, such as those disclosed in U.S. Pat. Nos. 3,718,748, 3,822,407, 3,842,182; and 4,137,809 all in the name of Bunger; U.S. Pat. No. 3,725,562-Munch, et al.; and U.S. Pat. No. 3,842,184-Kniepkamp, et al., typically rely on relatively bulky and expensive discrete transistorized logic circuitry. Due to the expense, space, and cabling problems associated with the use of discrete components, it is sometimes not practical in these systems to provide each note with separate triggering logic circuitry. Therefore, it was necessary to limit the arpeggio system to a portion of the keyboard or else to run groups of notes through the same gating circuit. Thus, prior art systems have limited versatility.

U.S. Pat. No. 4,154,131 to Studer et al. incorporates integrated circuitry based on transistor-transistor logic, overcoming some of these problems. However, it is a complex design which is ideally suited for use in relatively expensive, sophisticated electronic instruments. In contrast, the present invention is simpler, and can be utilized economically in relatively inexpensive musical instruments, including electronic organs.

BRIEF DESCRIPTION OF THE INVENTION

The present invention comprises an improved system for the generation of a variety of note patterns in an electronic musical instrument, such as an electronic organ. The invention is specifically designed to incorporate TTL integrated circuits for all control and sequencing functions. The core of the present invention is a counter chain of TTL parallel in-parallel out shift registers (e.g. No. 74195) connected in sequence, one for each musical note of the instrument, which are synchronously timed by a controllable system clock so as to transmit a pulse along the counter chain. A note gate associated with each musical note is electrically connected to, and operates in conjunction with, a corresponding shift register to control the passage of a signal from a tone generator to the output system. A musical tone is sounded when a note gate is enabled by the operation of an appropriate key switch of the instrument, and the corresponding shift register in the counter chain is switched into the operative state.

The shift registers are sequentially connected and capable of scanning in an up, down, or up and then down pattern, such that arpeggios and strums can be generated which are characterized by an up only note pattern, a down only note pattern, or an up and then down note pattern. The term "strum" is used to designate note patterns generated using the notes actually played on the keyboard. The term "arpeggio" is used to refer to note patterns which incorporate tones having a higher pitch, in addition to the notes actually played on the keyboard. Each note gate is connected to the system clock, and signals the clock when it passes a tone generator signal. The system clock then stops counting for a preselected time interval. This preselected interval, known as the "note rate interval" is the time between the initiation of successive notes. The note gate continues passing the tone generator signal until the clock resumes counting at the end of the note rate interval. When the clock is running, its frequency is sufficiently high (about 100 kHz) so that there is no audible variation in the delay between the playing of sequential triggered notes, regardless of the number of intervening unplayed notes.

In addition, in the preferred embodiment of the present invention, octavely related notes are electrically coupled through an OR logic gate so that the arpeggio generation for a given pattern of notes can be extended and repeated beyond the octave of musical notes corresponding to keys actually played when the OR logic gates are enabled by a control switch. The note gate circuitry of the preferred embodiment of the present invention incorporates sustain circuitry and release sustain circuitry which can be used to simulate the amplitude attenuation characteristics of various percussive or nonpercussive musical instruments such as a piano or a pipe organ.

The circuitry of the present invention is also adapted to interconnect with conventional musical instrument accessories, such as a rhythm system, to produce syncopated arpeggios and other known effects.

Thus, it is the principal object of the present invention to provide an improved digital arpeggio generating system designed to incorporate transistor-transistor logic devices in all control and sequencing functions.

It is a further object of the present invention to provide a compact and economical means of generating a variety of note patterns in an electronic musical instrument, overcoming the cost and space limitations of prior art devices.

These and other objects and advantages of the present invention are presented, by way of illustration and not limitation, by the following detailed description of a preferred embodiment of the present invention.

DETAILED DESCRIPTION OF THE PREFERRED EMBODIMENT

Figure 1:
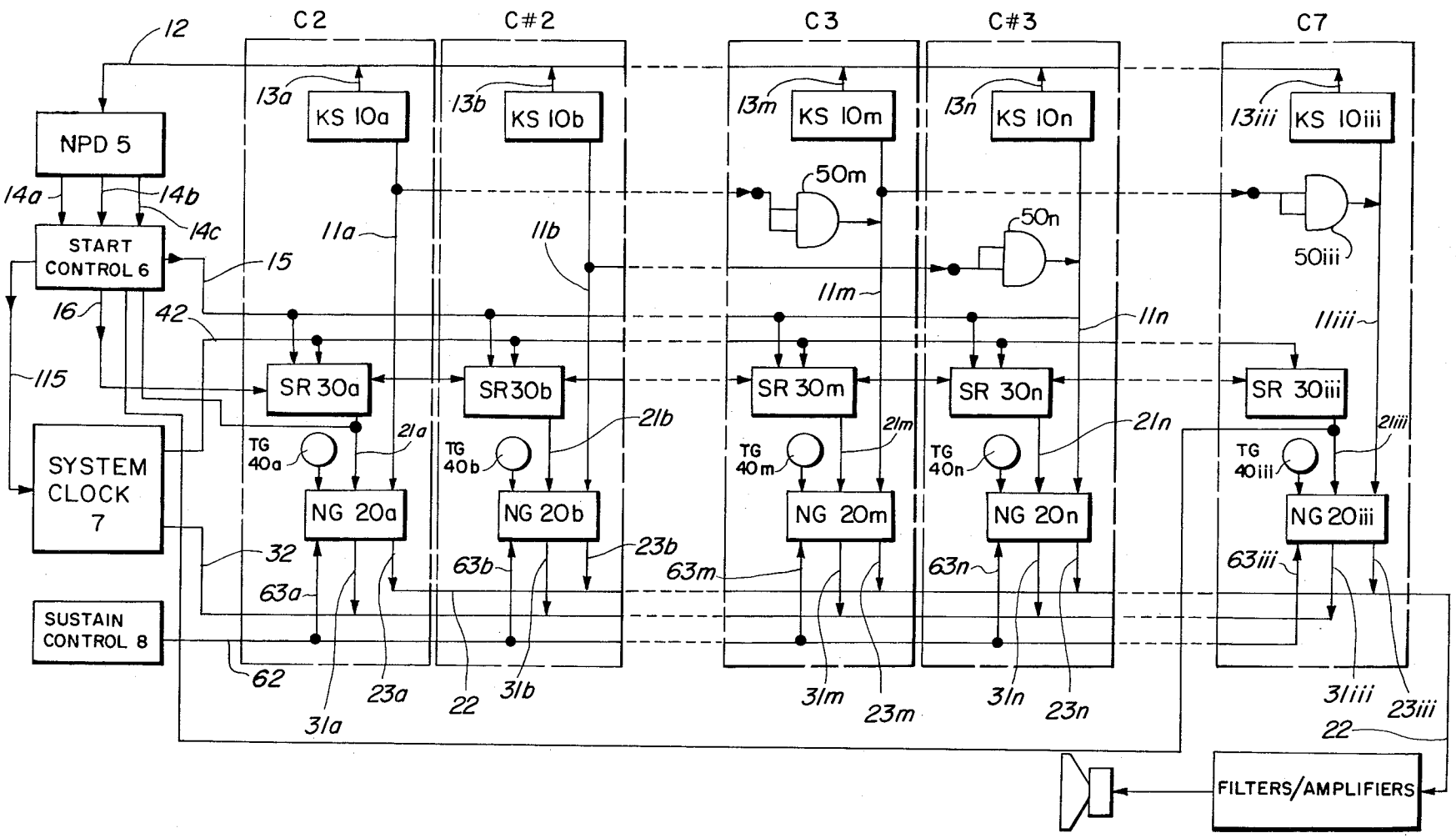
FIG. 1 is a block diagram of the preferred embodiment of the present invention.

With reference to FIG. 1, the preferred embodiment of the subject invention includes 61 manually operated key switches 10, one key switch corresponding to each different musical note of the instrument, covering five full octaves of the musical scale ranging from note C2 to note C7, inclusive. Key switch 10*a* corresponds to the note C2, key switch 10*b* corresponds to the note C#2, and so on through key switch 10*iii* which corresponds to the note C7. For convenience, only the circuitry associated with key switches 10*a*, 10*b*, 10*m*, 10*n*, and 10*iii* for the notes C2, C#2, C3, C#3 and C7 respectively, are shown in FIG. 1.

Each key switch 10 is connected by one of 61 leads 11 (designated 11*a* through 11*iii*) to one of 61 corresponding note gates 20, designated 20*a* through 20*iii* to correspond to key switches 10*a* through 10*iii*. Each note gate 20 is in turn connected by one of 61 leads 21 (designated 21*a* through 21*iii*) to one of 61 corresponding shift registers 30 (designated 30*a* through 30*iii*). When the arpeggio system is in use, the operation of a key switch 10 triggers the corresponding note gate 20. When the corresponding shift register 30 is enabled (as is more fully described below in connection with FIG. 2), the note gate 20 allows a signal produced by one of the 61 corresponding tone genertors 40 (designated 40*a* through 40*iii*) to pass to signal output bus 22. Signal output bus 22 carries the output of tone generators 40 to a selectable set of filters, amplifiers, and speakers, which are well known in the prior art, in order to produce sound of the desired characteristics.

Each key switch 10 is also connected by one of 61 leads 13 (designated 13*a* through 13*iii*) to a note played detector bus 12, which is connected to note played detector 5. When triggered by operation of a key switch 10, note played detector 5 activates start control 6 by application of a pulse to leads 14*a*, 14*b*, and 14*c* as described below. Start control 6 in turn enables the system clock 7 via lead 115 and also applies a signal to the input of the first shift register 30*a* via lead 16. Each shift register 30 has two possible states, either logic 0 or logic 1. The normal, unactivated state is logic 1. However, the signal from start control 6 changes the state of shift register 30*a* to logic 0. System clock 7 then begins simultaneously pulsing all 61 shift registers 30 via clock bus 42. Shift registers 30 are interconnected in a chain, and each shift register will read in the state of either the next adjacent higher or lower shift register, depending on the control signal on up-down control lead 15. Thus, each pulse of the system clock shifts the logic 0 along the shift register chain.

When, for example, key switch 10*m* is played, corresponding note gate 20*m* is enabled, and note played dectector 5 is activated, which in turn activates start control 6. When the logic 0 reaches shift register 30*m*, which corresponds to note gate 20*m*, the output of the corresponding tone generator 40*m* is passed to the signal output bus 22 via lead 23*m*. Note gate 20*m* simultaneously outputs a signal on lead 31*m* which is connected through the top note pulse repetition eliminator 80 (discussed below in connection with FIG. 3) to the clock hold trigger bus 32. Except when the top note pulse repetition eliminator is preset, this signal on the clock hold trigger bus 32 causes the system clock 7 to stop counting for a preselectable interval (i.e., the "note rate interval"). (The top note pulse repetition eliminator is preset by the change in state of the last shift register 30*iii*, as discussed below.) Since the clock is stopped with a logic 0 in the shift register 30*m*, the note gate 20*m* continues to pass the tone generator signal to the signal output bus 22 for an audible time period, the length of which is controlled by the sustain control 8 and the release sustain control, discussed below. When the clock 7 resumes pulsing, the logic 0 continues along the counter chain until it reaches another shift register 30 whose corresponding note gate is enabled. Thus, as logic 0 proceeds along the counter chain, an up only strum effect is generated. Depending on the mode selected, the logic 0 may pass off the end of the counter chain after the last shift register is reached, or it may be transmitted back down the chain, if up-down flip-flop 115 puts the appropriate logic on up-down control lead 15, resulting in an up-down strum. Alternatively, a signal on lead 115 prevents the clock from stopping during the upward portion of the counter scan, so that notes can only sound as the logic 0 proceeds down the counter chain. This will produce a down only strum effect.

In addition to being enabled by the operation of its corresponding key switch 10, a note gate 20 may be enabled by the operation of a key switch which corresponds to the same note in a lower octave. This optional function is accomplished in the preferred embodiment by connecting, for example, the output lead 11*a* of key switch 10*a* to both inputs of octave coupling AND logic gate 50*m* which corresponds to and is connected with the note gate 20*m* one octave above the note gate 20*a*. The output of the octave coupling AND gate 50*m* enables note gate 20*m*, in the same way operation of key switch 10*m* would. Similar octave coupling circuits are provided for each of the four upper octaves of notes in the preferred embodiment, such that each note gate 20 associated with a musical note in the four higher octaves is octavely coupled to its counterpart in the next lower octave, as described.

When a logic 0 is read into the shift register 30 of a note whose note gate 20 has been enabled by the operation of a keyswitch 10 corresponding to the same note in a lower octave, the note gate passes the tone generator signal to the signal output bus in the manner described above. In this way up only, up-down, and down only arpeggio effects can be created which will extend the range of the musical tones actually sounded from the notes corresponding to keys played to the top of the instrument's range. Since, for example, C2 is coupled to C3 and C3 is coupled to C4, and so on, operation of the key corresponding to C2 will enable all six note gates corresponding to the note C and all six notes will be played in sequence, when the octavely coupled arpeggio mode is selected.

When octave coupling is not desired, it can be disabled by removing the power supply to the AND logic gates 50. When neither the strum mode nor the arpeggio mode is desired, the clock may be disabled, establishing a logic 0 in all the shift registers, so as to cause each note gate 20 to pass the signal from its corresponding tone generator 40 whenever its corresponding key switch 10 is operated. In this mode, the device operates as a conventional musical instrument.

Figure 2:
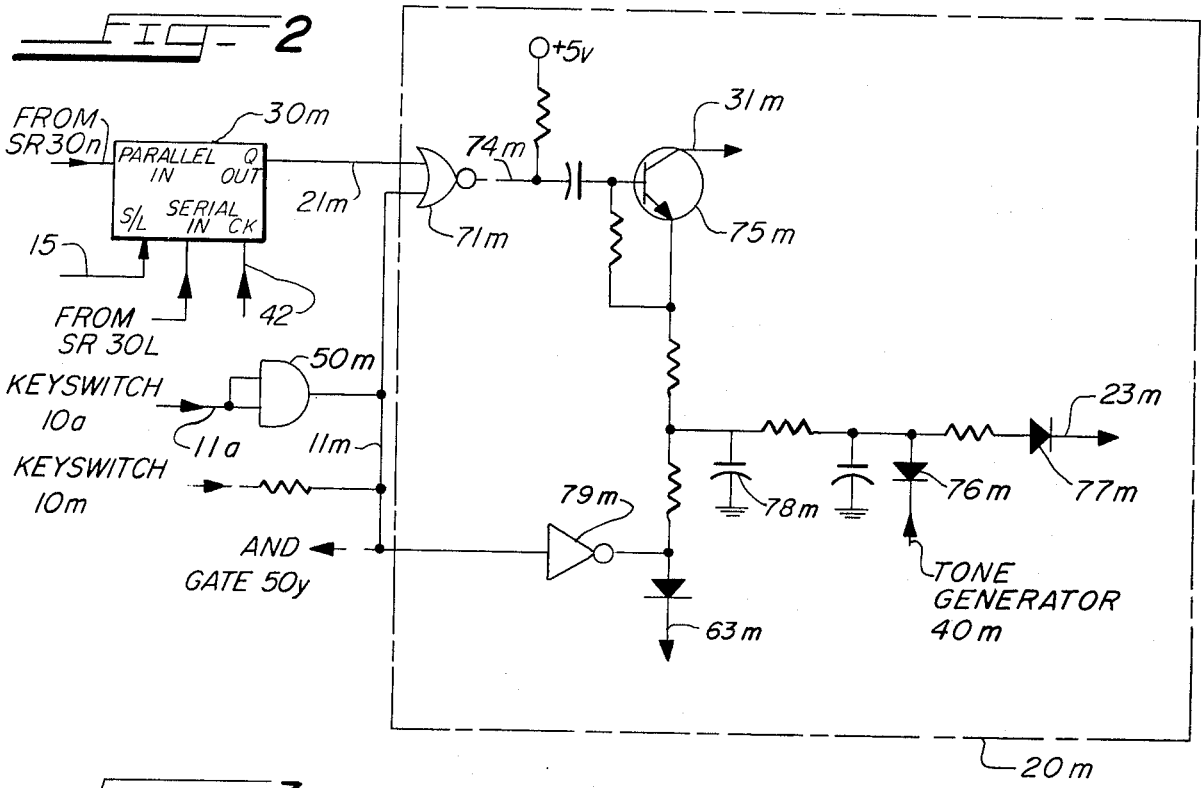
FIG. 2 is a circuit diagram of a typical stage of the preferred embodiment of the present invention corresponding to the note C3, including a note gate, a shift register, and an octave coupling gate.

With reference to FIG. 2, a typical stage of the invention, corresponding to the note C3, is shown, including note gate 20*m*, shift register 30*m*, and the octave coupling AND logic gate 50*m*. The principal logic function of note gate 20*m* is performed by conventional NOR logic gate 71*m*. The shift register input 21*m* of NOR logic gate 71*m* provides input as to the state of the Q output of corresponding shift register 30*m*. The key input 11*m* of NOR logic gate 71*m* provides input as to the state of corresponding key switch 10*m* via lead 11*m*, and the state of the next lower octavely related key switch 10*a* via leads 11*a* and 11*m* if the corresponding octave coupling AND logic gate 50*m* is operative, as discussed above.

The normal state of key input 11*m* is logic 1. When key 10*m* is played, the logic state goes to logic 0. If the octave coupling AND gate 50*m* is operative, the playing of key switch 10*a* (corresponding to the next lower octavely related note) would also cause the state of key input 11*m* to go to logic 0. However, if either the strum or arpeggio modes is selected, the normal state of shift register input 21*m* is logic 1, and the logic NOR gate 71*m* will not fire regardless of the state of key input 11*m*. But, if a logic 0 is read into shift register 30*m* from either of the adjacent shift registers, 301 or 30*n*, as controlled by up-down control lead 15, then inputs 11*m* and 21*m* of NOR logic gate 71*m* both are at logic 0, the gate is triggered, and a logic 1 is transmitted to the NOR gate output 74*m*. The firing of the NOR logic gate 71*m* fires the gate transistor 75*m*. The emitter output of gate transistor 75*m* biases signal input diode 76*m* and output diode 77*m* so that the signal provided by tone generator 40*m* is passed through diodes 76*m* and 77*m* via output lead 23*m* to the signal output bus 22 shown in FIG. 1.

The emitter output of gate transistor 75*m* charges sustain timing capicitor 78*m*. After gate transistor 75*m* stops firing, the signal input diode 76*m* and output diode 77*m* remain forward biased and continue to pass the tone generator signal to the output lead 23*m* for as long as a sufficient charge remains on the sustain timing capacitor 78*m*. The rate at which sustain timing capacitor 78*m* discharges determines the length of time for which a tone continues to sound once the gate transistor 75*m* has been shut off by either the release of the key or the restart of the clock at the expiration of the note rate interval. The rate at which the sustain timing capacitor will discharge while a key switch remains activated is regulated by the sustain control 8 (shown in FIG. 5). The sustain control 8 is a grounded collector transistor with an adjustable base voltage. By adjusting the base voltage, long sustain (as in an organ) or short sustain (as in a percussive system such as a piano) can be produced. The sustain bus 62 is connected to the emitter of the transistor so that the base voltage controls the rate at which the sustain timing capacitor 78*m* can discharge through lead 63*m* and sustain bus 62 to ground.

The rate at which the sustain timing capacitor 78*m* discharges when the organ key is released is controlled by inverter 79*m*. Ordinarily, there is no power supplied to inverter 79*m*. In this situation, sustain timing capacitor 78*m* can only discharge via the sustain bus 63, causing long release sustain (i.e., no damping). When short release sustain is desired, power is supplied to inverter 79*m*. In this situation, when the key is released the input to inverter 79*m* goes from logic 0 to logic 1 and the output of inverter 79*m* therefore goes from logic 1 to logic 0. This logic 0 is a ground to which sustain timing capacitor 78*m* can discharge relatively rapidly, producing a damping effect.

Figure 3:
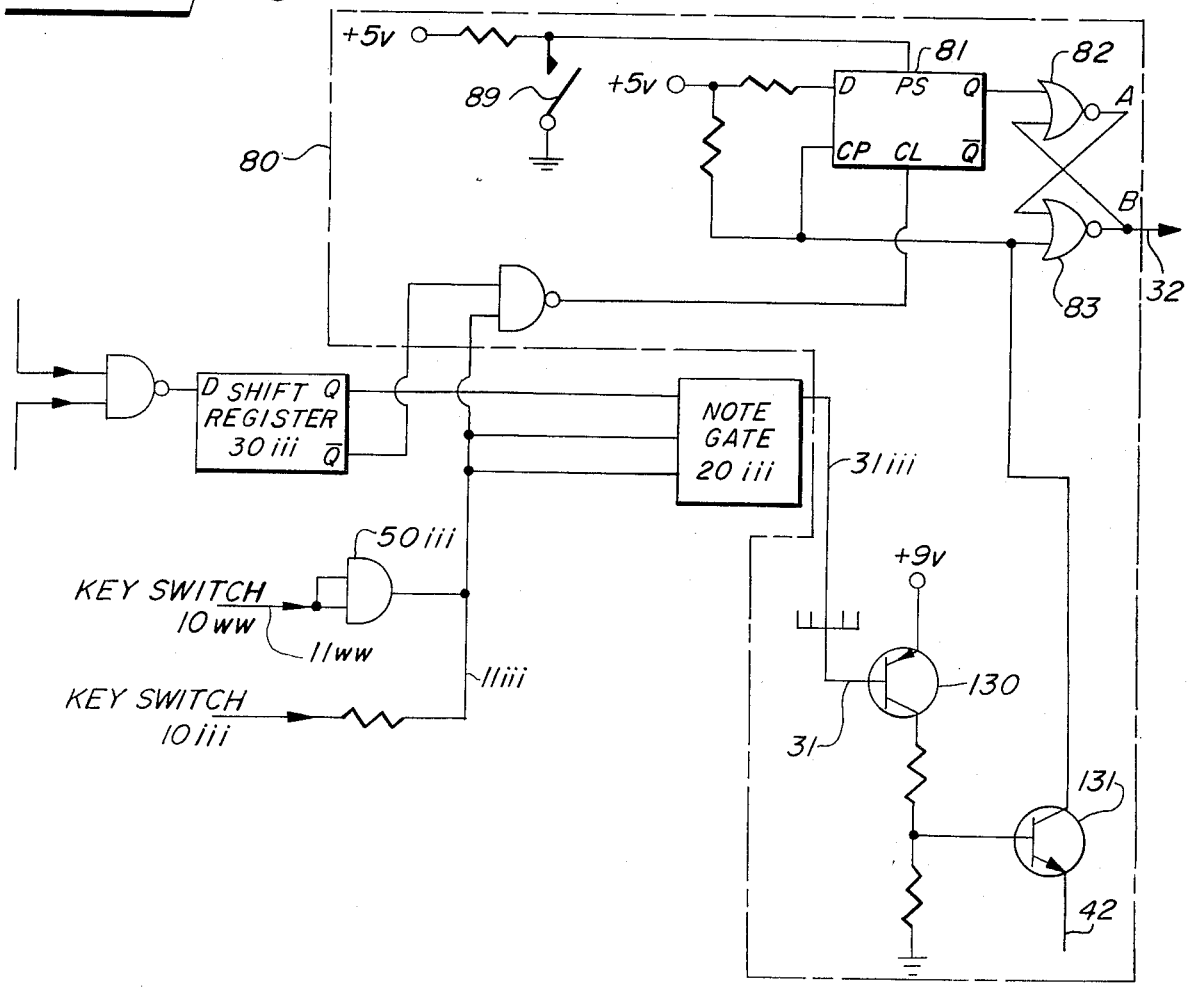
FIG. 3 is a circuit diagram of the sixty-first stage of the preferred embodiment of the present invention, and also shows the top note pulse repetition eliminator and the system clock hold trigger circuit.

The collector of the gate transistor 75*m* is connected to the system clock hold bus 32 through the top note pulse repetition eliminator 80 (as shown in FIG. 3), via lead 31*m*. When flip-flop 81 is not preset, the pulse on the collector 31*m* of gate transistor 75*m* when gate transistor 75*m* fires causes a pulse on clock hold trigger bus 32, causing the system clock 7 to stop counting for the note rate interval.

As illustrated in FIG. 3, the final, sixty-first shift register 30*iii* is connected to a top note pulse repetition eliminator 80 which prevents double sounding of the top note played in an up-down mode. Ordinarily, flip-flop 81 is in the clear state. In this configuration, the pulse produced on any of the sixty-one leads 31*a* through 31*iii* when its corresponding gate transistor 75 fires is passed through transistors 130, 131, and NOR gate 83 to clock hold trigger bus 32. This pulse causes the clock 7 to stop, thereby permitting the triggered note to sound. When an up-down mode is selected, it is desirable to suppress the second sounding of the last note played during the up cycle, when the down cycle begins. This function is accomplished by the top note pulse repetition eliminator. Flip-flop 81 is normally held in the preset state by the action of the signal from transistor 131. When the sixty-first shift register 30*iii* is scanned, the not-Q output of the shift register 30*iii* clears flip-flop 81. In its clear state, flip-flop 81 will prevent the next pulse on one of the 61 leads 31*a* through 31*iii* from being passed to clock hold trigger bus 32, by means of NOR gates 82 and 83. Thus, on the downward scan, the note which was the last note played on the upward scan will not sound a second time since the clock will not stop for that note on the downward scan. However, the suppressed pulse will return flip-flop 81 to the preset state so that the clock can stop to sound succeeding notes on the downward scan. When the switch 89 is closed, the arpeggio system is in the "down only" mode, and the note suppressing function of the top note pulse repetition eliminator 80 is disabled.

Figure 4:
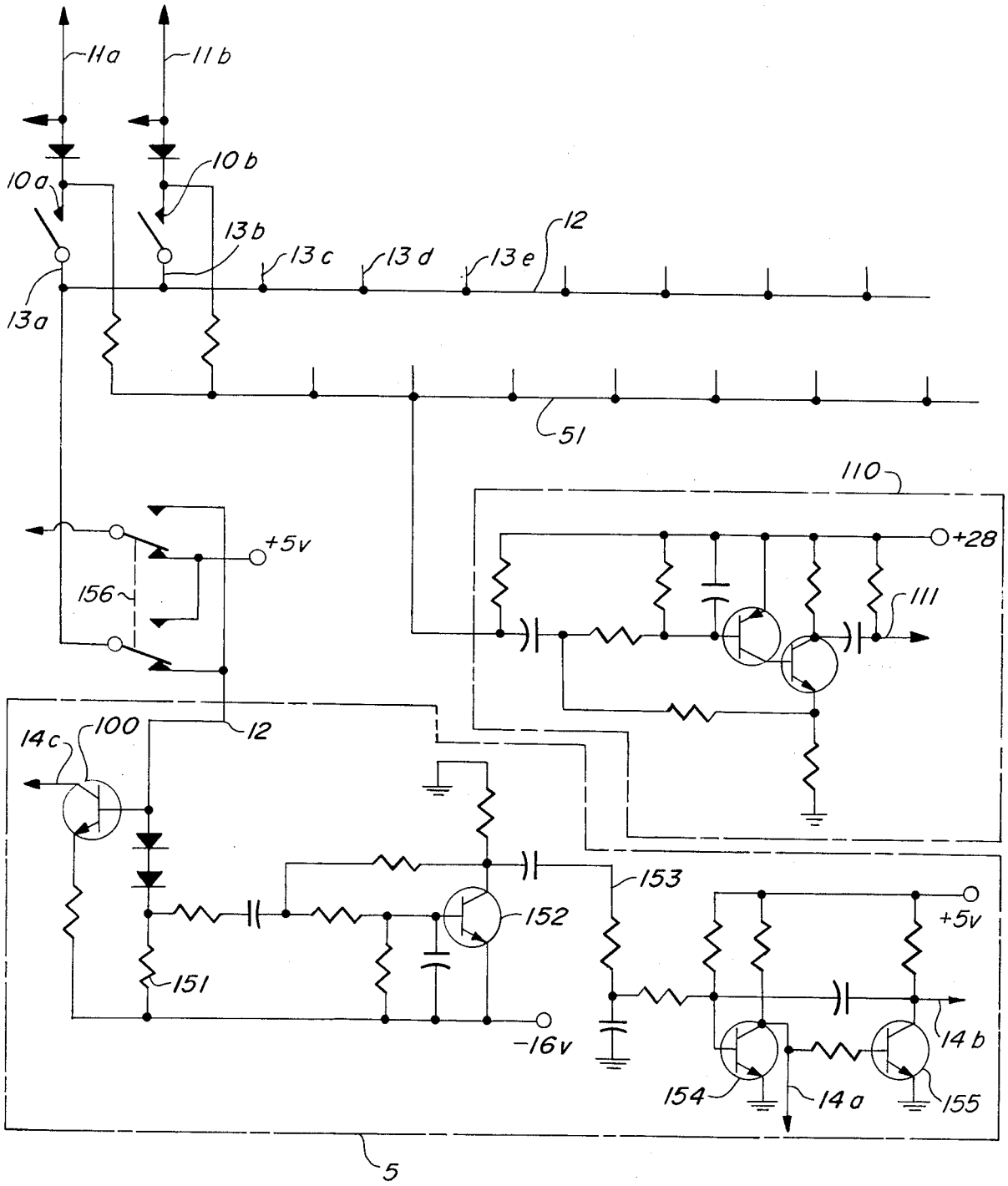
FIG. 4 is a circuit diagram of the key switches and note played detector of the preferred embodiment of the present invention.

As illustrated in FIG. 4, each keyswitch 10*a* through 10*iii* is connected to the note played detector 5 via bus 12 and corresponding leads 13*a* through 13*iii*, and to its corresponding note gate 20*a* through 20*iii* via corresponding leads 11*a* through 11*iii*. A keying voltage is supplied to the keyswitches 10 via supply bus 12. When a keyswitch 10 is closed, current passes to the corresponding note gate 20 via corresponding lead 11. This current triggers note detector transistor 100, which signals the start control 6 via lead 14*c*. The current through the base of transistor 100 causes a voltage drop across resistor 151. This voltage drop is shaped into a pulse by transistor 152. The output of transistor 152 on lead 153 fires the one-shot composed of transistors 154 and 155. When the one-shot fires, the output on leads 14*a* and 14*b* resets the up-down flip-flop 116 of start control 6 (see FIG. 5).

FIG. 4 also shows the rhythm-interface circuit 110 which is connected to keyswitches 10 via rhythm bus 51. Rhythm interface circuit 110 is connected to a rhythm control (not shown) via lead 111. The rhythm control circuit is known in the art and its configuration is not part of the present invention as such. Double-pole, double-throw switch 156 can be used to change from the solo keyswitches to the accompaniment keyswitches in order to permit the automatic arpeggio system to be used with either manual.

Figure 5:
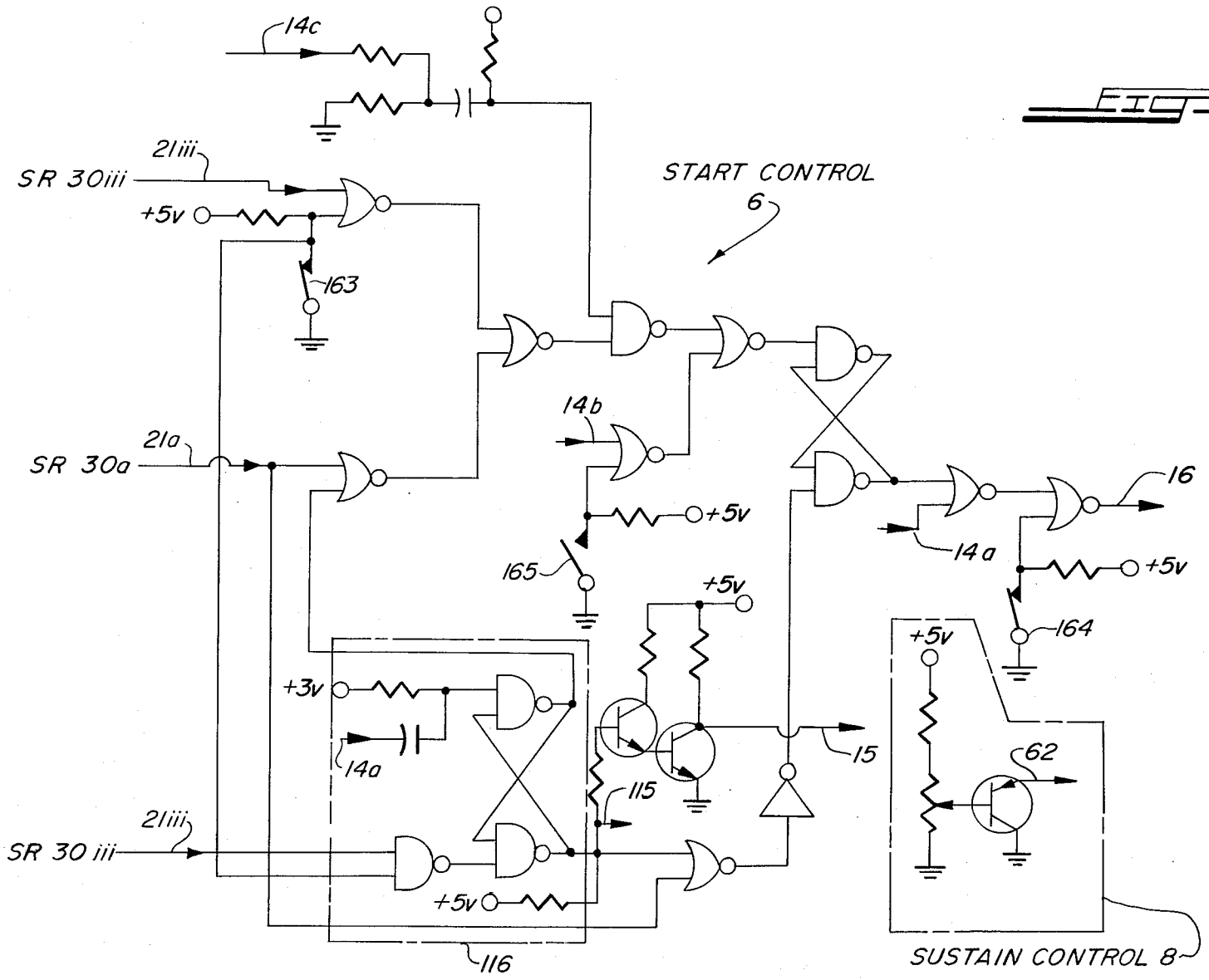
FIG. 5 is a circuit diagram of the start control and of the sustain control of the preferred embodiment of the present invention.

As illustrated in FIG. 5, start control 6 is triggered by note played detector 5 via leads 14*a*, 14*b*, and 14*c*. Start control 6 also incorporates up-down flip flop 116 which controls the direction in which an arpeggio will proceed.

The signals received from note played detector 5 on leads 14*a*, 14*b* and 14*c* cause start control 6 to generate a sequence of logic 1's and logic 0's as described above, which are fed into shift register 30*a* by start control output lead 16. The condition of up-down flip-flop 116 is read into the shift/load input of shift registers 30*a* through 30*ii* via lead 15. Thus, when start control 6 is activated by note played detector 5, the shift registers 30 will initially be scanned in an upward direction. Up-down flip-flop 116 also receives input from shift registers 30*a* and 30*iii* to set the up-down flip-flop 116 into the up or down state, respectively, so that continuing arpeggios and strums will proceed in the appropriate direction. When switch 98 (see FIG. 6) is closed, a signal on lead 115 of the start control 6 serves to disable the sounding of notes during the upward scan when a down arpeggio is selected. When switch 163 is closed, up-down flip-flop 116 is locked in the "up" mode, and therefore an up only arpeggio is produced. When switch 163 is open, the pulse on line 21*iii* which results when the logic "0" reaches shift register 30*iii* switches up-down flip-flop 116 into the down mode, thereby producing an up-down arpeggio. When switch 164 is open, the start control applies a "0" to line 16, thereby causing the note gates to respond to the playing of the keys in a normal (non-arpeggio) mode. When switch 165 is closed, a multitone effect is produced by permitting a logic "0" to be introduced into the shift register chain whenever any keyswitch is activated. The presence of more than one logic "0" in the shift register chain permits more than one note to sound at a given instant. When switch 165 is open, only the first key played will introduce a logic "0" into the shift register chain. This permits only one note to sound at a time.

Figure 6:
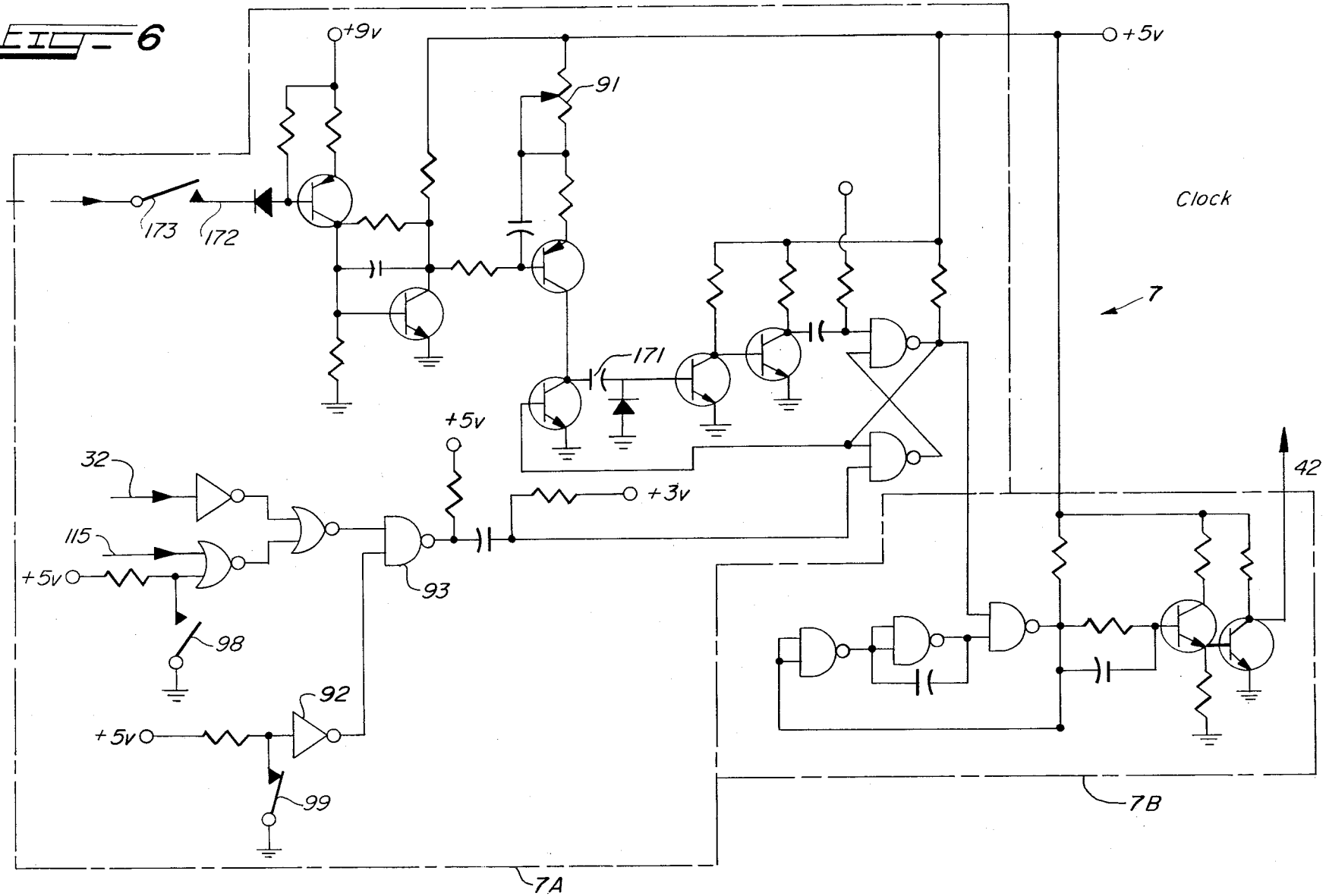
FIG. 6 is a circuit diagram of the system clock of the preferred embodiment of the present invention.

Referring to FIG. 6, system clock 7 consists of a one shot 7A and a free running clock 7B. When the one shot 7A is reset, the free running clock 7B pulses shift registers 30 via clock bus 42 thereby propagating the logic 0 along the shift register chain in a direction controlled by up-down flip-flop 115 as described above. When one of the gate transistors 75 fires (see FIG. 2), a pulse is produced on clock hold trigger bus 32 as described above. This pulse triggers one shot 7A thereby stopping free running clock 7B. This allows the triggered note to sound. The clock will stay in the hold state allowing the note to sound until the one shot 7A recovers. The recovery of the one shot is governed by the time it takes capacitor 171 to recharge, which is, in turn, governed by various manual controls such as control potentiometer 91 and the voltage applied to lead 172 which is in turn under the control of the potentiometer on the expression pedal. This control is enabled when switch 173 is closed.

The clock 7 can be disabled to produce a normal (non-arpeggio) mode of operation by applying a logic 1 to inverter 92 (by opening switch 99) so as to lock the clock start NAND logic gate 93 into a logic 1 output, regardless of the hold signals received on the other input of clock start NAND logic gate 93.

It should be apparent that various changes, alterations, and modifications may be made to the embodiment of the present invention illustrated and described herein without departing from the spirit and scope of the present invention as defined in the appended claims.

I claim:

1. In an electronic musical instrument, including tone generating means, a plurality of note selecting switches corresponding to notes of a musical scale, and an acoustic output system, an improved system for sounding notes comprising:

a note pattern producing means comprising a plurality of serially connected shift registers, there being a shift register for each of said note selecting switches, which sequentially passes tone signals to the acoustic output system in response to the actuation of at least one of the note selection switches; and release sustain means for controlling the length of time a tone signal will continue to be passed to the acoustic output system after a note selection switch is deactivated.

2. In an electronic musical instrument, including tone generating means, a plurality of note selecting switches corresponding to notes of a musical scale, and an acoustic output system, an improved system for sounding notes comprising:

a note pattern producing means comprising a plurality of serially connected shift registers, there being a shift register for each of said note selecting switches, which sequentially passes tone signals to the acoustic output system in response to the actuation of at least one of the note selection switches; and rhythm synchronization means for controlling the timing of the sounding of tone signals passed to the acoustic output system in accordance with a preselected rhythm pattern.

3. In an electronic musical instrument, including tone generating means, a plurality of note selecting switches corresponding to notes of a musical scale, and an acoustic output system, an improved system for sounding notes comprising:

a note pattern producing means comprising a plurality of serially connected shift registers, there being a shift register for each of said note selecting switches, which sequentially passes tone signals to the acoustic output system in response to the actuation of at least one of the note selection switches;

release sustain means for controlling the length of time a tone signal will continue to be passed to the acoustic output system after a note selection switch is deactivated; and rhythm synchronization means for controlling the timing of the sounding of tone signals passed to the acoustic output system in accordance with a preselected rhythm pattern.

4. In an electronic musical instrument including tone generating means, a plurality of note selecting switches corresponding to notes of a musical scale, and an acoustic output system; an improved system for sounding patterns of notes comprising:

control means, comprising a plurality of serially interconnected shift register means, equal in number to said plurality of noted selecting switches, for controlling the sequence and pattern of tone signals transmitted to the output system; and, a plurality of note gate means, controlled by said control means, for gating tone signals from said tone generating means to said output system in response to the actuation of at least one of the note selection switches.

5. An improved system for sounding patterns of notes, as claimed in claim 4, wherein said control means comprises:

a plurality of shift register means, one shift register means corresponding to each note selection switch; and timing means for transmitting logic signals to each of said shift register means.

6. An improved system for sounding patterns of notes, as claimed in claim 5, further comprising an octave coupling means for enabling note gate means to gate tone signals octavely related to actuated note selection switches.

7. An improved system for sounding patterns of notes, as claimed in claim 4 or claim 5, further comprising a variable sustain means electrically connected to at least one of the plurality of note gate means, for controlling the length of time the note gate means will continue to gate a tone signal to the output system after the note gate means has been deactivated by the control means.

8. An improved system for sounding patterns of notes, as claimed in claim 4 or claim 5, further comprising a variable decay control means electrically connected to at least one of the plurality of note gate means, for controlling the decay time of the sounding of tones transmitted to the output system.

9. An improved system for sounding a pattern of notes, as claimed in claim 4 or claim 5, further comprising a rhythm synchronization means electrically connected to the control means, for sounding the sequence of sounded notes in a preselected rhythm pattern.

10. An improved system for sounding patterns of notes, as claimed in claim 7, further comprising:

octave coupling means for enabling note gate means to gate tone signals octavely related to actuated note selection switches;

variable decay control means electrically connected to at least one of the plurality of note gate means, for controlling the decay time of the sounding of tones transmitted to the output system; and, rhythm synchronization means electrically connected to the control means, for sounding the sequence of sounded notes in a preselected rhythm.

11. In an electronic musical instrument including a set of tone generators, at least one keyboard of key switches corresponding to notes of a musical scale, and an acoustic output system; an improved system for sounding patterns of notes comprising:

a plurality of note gate means, each such note gate means electrically connected to a tone generator and to a key switch of said at least one keyboard;

a control means comprising a chain of shift register means electrically interconnected in series, one such shift register means interconnected to each of said note gate means for controlling the sequence of gating by said note gate means;

a clock means for controlling said shift register means;

a note played detector means interconnected to each of said key switches and to said clock means for controlling the operation of said clock means in response to activation of said key switches;

whereby the gating of tones to the acoustic output system by the musical instrument in response to actuation of said key switches is in a preselectable sequence.

12. An improved system for sounding patterns of notes, as claimed in claim 11, further comprising an octave coupling means for enabling the note gate means to gate tone signals octavely related to actuated key switches to the acoustic output system.

13. An improved system for sounding patterns of notes, as claimed in claim 11 or claim 12, further comprising a variable sustain means electrically connected to at least one of the plurality of note gate means, for controlling the length of time the note gate means will gate a tone signal to the acoustic output system after a key switch is deactivated.

14. An improved system for sounding patterns of notes, as claimed in claim 11 or claim 12, further comprising a variable decay control means electrically connected to at least one of the plurality of note gate means, for controlling the decay time of the sounding of tones transmitted to the acoustic output system.

15. An improved system for sounding a pattern of notes, as claimed in claim 11 or claim 12, further comprising a rhythm synchronization means electrically connected to the control means, for sounding the sequence of sounded notes in a preselected rhythm pattern.

16. An improved system for sounding patterns of notes, as claimed in claim 13, further comprising:

variable decay control means electrically connected to at least one of the plurality of note gate means, for controlling the decay time of the sounding of tones transmitted to the output system; and, rhythm synchronization means electrically connected to the control means, for sounding the sequence of sounded notes in a preselected rhythm.

* * * * *

UNITED STATES PATENT AND TRADEMARK OFFICE

CERTIFICATE OF CORRECTION

PATENT NO. : 4,279,187

DATED : July 21, 1981

INVENTOR(S) : Joseph L. Kappes

It is certified that error appears in the above-identified patent and that said Letters Patent are hereby corrected as shown below:

Column 3, line 21, "genertors" should be --generators--.

Column 3, line 49, "dectector" should be --detector--.

Column 8, line 50, "noted" should be --note--.

Signed and Sealed this

*Tenth* Day of *November 1981*

[SEAL]

*Attest:*

GERALD J. MOSSINGHOFF

*Attesting Officer*

*Commissioner of Patents and Trademarks*